US005993553A

United States Patent [19]

Lim et al.

[11] Patent Number: 5,993,553

[45] Date of Patent: Nov. 30, 1999

[54] EXTRUSION COATING APPARATUS

[75] Inventors: Jae-Choon Lim; Kyung-Soo Lee; Seok-Jun Lee, all of Kumi, Rep. of Korea

[73] Assignee: Kolon Industries, Inc., Seoul, Rep. of Korea

[21] Appl. No.: 08/901,334

[22] Filed: Jul. 28, 1997

[30] Foreign Application Priority Data

Jul. 30, 1996 [KR] Rep. of Korea ..... 96-34478

[51] Int. Cl.[6] ..... B05C 3/02

[52] U.S. Cl. ..... 118/410; 118/419

[58] Field of Search ..... 118/410, 419; 425/461

[56] References Cited

U.S. PATENT DOCUMENTS 3,217,358 11/1965 Kihara .

3,479,989 11/1969 Hunter et al. ..... 118/410

*Primary Examiner*—Brenda A. Lamb

*Attorney, Agent, or Firm*—Birch, Stewart, Kolasch & Birch, LLP.

[57] ABSTRACT

An extrusion coating apparatus including a body having a liquid dispensing passage for dispensing a coating liquid on a surface of a sheet, the liquid dispensing passage being connected to a manifold formed inside the body, and a hollow core which is disposed in the manifold at a predetermined distance apart from the manifold and includes in the longitudinal direction thereof, a slit through which the coating liquid supplied into the hollow core is uniformly extruded. The apparatus dispenses a coating liquid at a constant pressure to the surface of the sheet through the hollow core, the manifold, and the liquid dispensing passage so that a coating layer having a uniform thickness in the longitudinal and transverse directions thereof is formed on the surface of the sheet. The apparatus can adjust the thickness of the coating layer, and can be easily handled.

7 Claims, 1 Drawing Sheet

EXTRUSION COATING APPARATUS

BACKGROUND OF THE INVENTION

1. Field of the Invention

The present invention relates to an extrusion coating apparatus, and mole particularly to an extrusion coating apparatus which can adjust a thickness of a coating layer by dispensing a coating liquid at a constant pressure on a surface of a sheet to be coated, and which can be easily handled.

2. Description of Related Art

Generally, to form a coating layer of a predetermined thickness on a surface of a sheet, a roll-type coating method, in which a coating liquid is applied to the surface of the sheet by a rotating roll, is widely used. The roll-type coating method includes reverse-type roll coating, a gravure-type roll coating, kiss-type roll coating, and a forward-type roll coating. In each of the roll coating methods, the coating is carried out in either an off-set manner or a direct manner. In addition, the above roll coating methods can be incorporated with other coating mechanisms such as an extruding apparatus or a bar coating apparatus in order to carry out coating.

Among the above mentioned roll coating methods, reverse-type roll coating is widely used, so it is advantageously used to coat small lots of various sorts of materials. However, with reverse-type roll coating, it is difficult to adjust the thickness of the coating layer, so the stability of the coating layer is reduced.

Gravure-type roll coating is used for coating a single sort of material in large quantities. However, gravure-type roll coating not only requires a separate device for uniformly leveling the coating layer, but also the leveling work is very difficult to perform. In addition, in order to adjust the thickness of the coating layer, gravure-type roll coating requires a separate gravure roll suitable for the thickness of the coating layer. Furthermore, it is difficult to replace a used gravure roll with a new gravure roll, so time and labor force are unnecessarily wasted.

Kiss-type roll coating has a more simple construction than reverse-type and gravure-type roll coating. However, kiss-type roll coating must be incorporated with bar coating method, so coating speed and viscosity of the coating liquid are limited. Accordingly, a coating liquid having a low viscosity and a low flow rate is suitable only kiss-type roll coating, so that it is improper for kiss-type roll coating to be used in a fine coating.

On the other hand, there are other coating methods in which a knife or blades are used. However, these coating methods have problems that the coating speed is low and accurate coating is difficult.

While each of the above coating methods is being performed, the coating liquid is exposed to the atmosphere before coating it on the surface of the sheet, and tile remaining coating liquid that has not been coated on the surface of the sheet is stored in a store vessel or returned to a coating liquid supplying tank. However, the coating liquid includes a volatile solvent. Therefore, if the coating liquid is exposed to the atmosphere while the coating work is being carried out, the solvent is evaporates and the density and viscosity of the coating liquid are increased and the thickness of the coating layer becomes heavy, thereby resulting a inferior coating.

SUMMARY OF THE INVENTION

The present invention overcomes the above described problems. Accordingly, it is an object of the present invention to provide an extrusion coating apparatus which can reduce the time that a coating liquid is exposed to air thereby allowing the coating liquid to have proper density and viscosity, and can adjust a thickness of a coating layer so that an uniform coating layer can be obtained.

To achieve the above object, the present invention provides an extrusion coating apparatus comprising a body having a liquid dispensing passage for dispensing a coating liquid on a surface of a sheet to be coated. The liquid dispensing passage is connected to a manifold formed inside the body. A hollow core is disposed in the manifold at a predetermined distance apart from the manifold and has a slit along the longitudinal direction thereof through which the coating liquid supplied into the hollow core is uniformly extruded.

BRIEF DESCRIPTION OF THE DRAWINGS

The above object, and other features and advantages of the present invention will become more apparent by describing a preferred embodiment thereof with reference to the accompanying drawings, in which.

DETAILED DESCRIPTION OF PREFERRED EMBODIMENT

Hereinafter, a preferred embodiment of the present invention will be described in detail with reference to the drawings.

Figure 1:
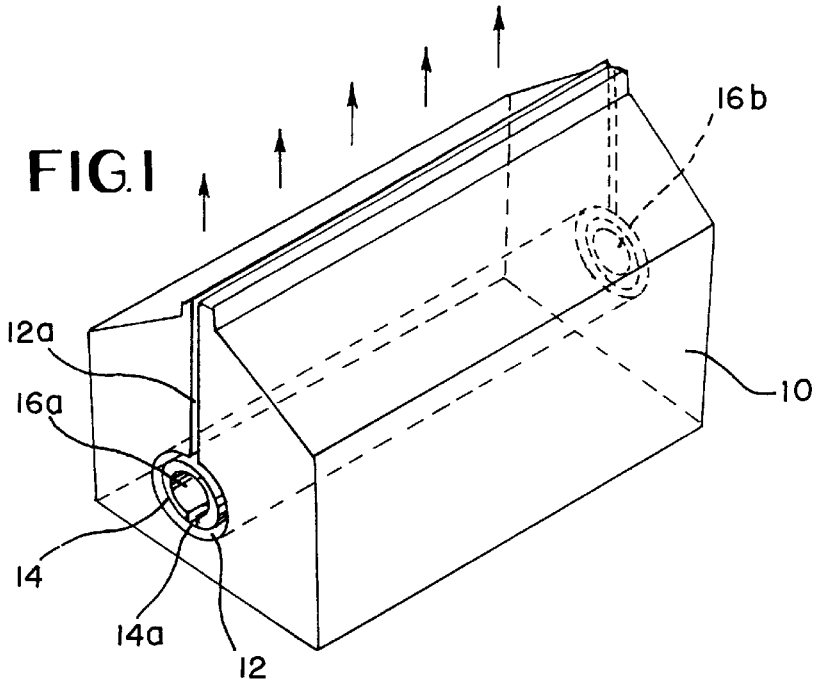
FIG. 1 is a perspective view showing an extrusion coating apparatus in accordance with an embodiment of the present invention.
Figure 2:
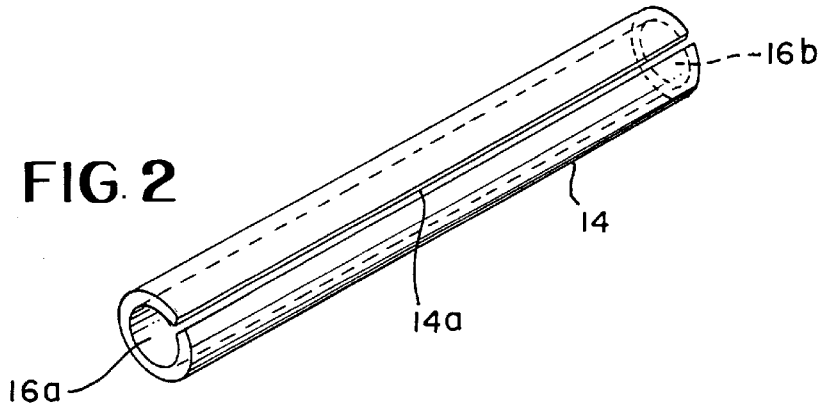
FIG. 2 is a perspective view showing a hollow core according to the present invention.
Figure 3:
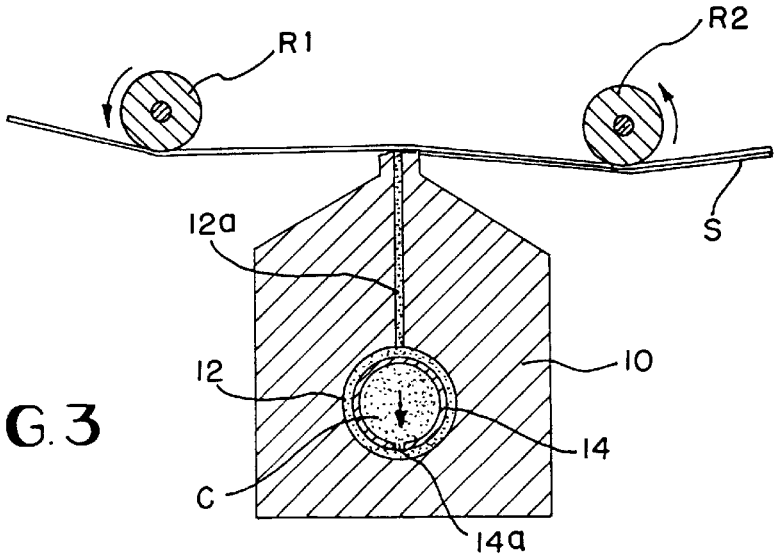
FIG. 3 illustrates the operation of an extrusion coating apparatus according to the present invention.

FIG. 1 is a perspective view of an extrusion coating apparatus according to the present invention, FIG. 2 is a perspective view of a hollow core disposed in the extrusion-type coating apparatus according to the present invention, and FIG. 3 is an operational view of the extrusion coating apparatus according to the present invention.

In the figures, a body 10 has a cylindrical manifold 12 formed therein and an elongate liquid dispensing passage 12*a* connected to the manifold 12 for dispensing a coating liquid of a predetermined pressure to a surface of a sheet to be coated.

A hollow core 14 having a slit 14*a* formed along the longitudinal direction thereof is disposed in the manifold 12 at a predetermined distance apart from the manifold 12.

An outer wall of the hollow core 14 is preferably uniformly spaced apart from an inner wall of the manifold 12. Preferably, the width of a space formed between the outer wall of the hollow core 14 and the inner wall of the manifold 12 is less than 5 mm so as to minimize a swirl flow in the coating liquid or a turbulent flow.

The coating liquid is supplied into the hollow core 14 by means of a separate coating liquid supplying device (not shown). The hollow core 14 has a coating liquid receiving hole 16*a* at one end thereof into which the coating liquid is supplied, and a coating liquid discharging hole 16*b* at the other end thereof through which the coating liquid that has not been introduced into the slit 14*a* and the liquid dispensing passage 12*a* is discharged and recirculated.

It is preferred to arrange the slit 14 in opposition to the liquid dispensing passage 12*a* (see, for example, FIG. 3).

Preferably, the hollow core 14 has an inner diameter which gradually becomes larger in the longitudinal direction from the coating liquid receiving hole 16*a* to the coating liquid discharging hole 16*b*. The inner diameter of the hollow core 14 is selectively determined according to the quality of the coating liquid and the amount of the coating liquid. However, in order to obtain a stable coating layer, the size of an inner diameter of the coating liquid receiving bole 16*a* should be set at least in the ratio of 80 to 100 with respect to the size of an inner diameter of the coating liquid discharging hole 16*b*.

In addition, the width of the slit 14*a* formed in the hollow core 14 is preferably set in the range of 1/100 to 10/100 with respect to the size of the mean inner diameter of the hollow core 14, i.e., with respect to the arithmetic mean size of inner diameters of the coating liquid receiving hole 16*a* and the coating liquid discharging hole 16*b*.

In order to obtain a favorable coating layer, it is preferred to make the inner diameter of the hollow core 14 less than 40 mm, and it is more preferred to make the inner diameter of the hollow core 14 in the range of 5 to 20 mm.

In addition, the coating liquid flowing into the hollow core 14 may create bubbles and a turbulent flow in the hollow core 14 when the Reynolds number thereof is more than 2000. Accordingly, it is preferred to maintain the Reynolds number of the flowing coating liquid less than 2000. In order to obtain a favorable coating layer, the viscosity of the coating liquid is preferably less than 3000 centipoise, and more preferably less than 2000 centipoise.

The coating apparatus of the present invention can a coating layer having a thickness of, for example, 0.2 to 20 $\mu$m when the coating layer has been dried, and can be used in both a low speed coating and high speed coating.

On the other hand, contact portions of the body 10 and the hollow core 14, which make contact with the coating liquid, preferably have a surface roughness of less than 3 $\mu$m. The contact portions are preferably made of stainless steel plated at a surface thereof with chrome, or an abrasion-resisting material such as a cemented carbide alloy.

Reference numerals R1 and R2 in FIG. 3 represent guide rolls for conveying a sheet S to be coated.

The sheet S may be paper, a synthetic resin film, or a film coated with a synthetic resin. For example, a poly olefin-based film such as polyethylene or polypropylene; a polyester vinyl-based film such as polyvinyl acetate, polyvinyl chloride, or polystyrene; a polyester-based film such as polyethylene terephtalate, polyethylene-2, or 6-naphtalate; a cellulose ester based-film such as cellulose triacetate, or cellulose acetate; and a polyamide-based film such as 6,6-nylon or 6-nylon may be used.

In addition, the coating liquid may be, for example, a polymer solution, a water-dispersible solution, or an organic solvent-dispersible solution. For example, a poly vinyl alcohol aqueous, a carboxyl methyl cellulose aqueous, a solution of maleic anhydride-vinyl acetate copolymer resin, a cellulose ester solution, a poly vinyl acetal solution, poly vinyl chloride or poly vinyliden chloride solutions, a polystyrene solution, a phenol solution, an acryl resin solution, a polyurethane solution, a gelatine solution, and a dispersible solution made by compounding inorganic substances with the above solutions can be used as a coating liquid.

The aforementioned inorganic substances may include kaoline, calcium carbonate, alumina, silica, carbon black, oxidized steel, titan dioxide, metal powder, and compounds including at least one of the above materials. The present invention can be used with for a dispersible solution including pigments and dyes.

Hereinafter, the operation of the extrusion apparatus having the above construction will be described.

Firstly, the sheet S is conveyed in one direction along the guide rolls R1 and R2 by a driving mechanism (not shown). Then, the coating liquid C is supplied into the coating liquid receiving hole 16*a* of the hollow core 14 by means of a separate extrusion device.

At this time, the coating liquid that has been introduced into the coating liquid receiving hole 16*a* of the hollow core 14 flows towards the coating liquid discharging hole 16*b*. While flowing towards the coating liquid discharging hole 16*b*, the coating liquid is concurrently extruded into the manifold 12 through the slit 14*a* formed in the hollow core 14, and then the coating liquid extruded into the manifold 12 is exhausted at a predetermined pressure out of the body 10 through the liquid dispensing passage 12*a*.

Accordingly, the coating liquid C exhausted from the body 10 can be coated at a predetermined thickness on the surface of the sheet S which is conveyed in a proper velocity.

The thickness of the coating liquid C coated on the surface of the sheet S can be adjusted by controlling the rate at which the coating liquid C is supplied into the hollow core 14 and the velocity at which the sheet S is conveyed.

In addition, since the inner diameter of the hollow core 14 gradually becomes larger in the longitudinal direction from the coating liquid receiving hole 16*a* to the coating liquid discharging hole 16*b*, the coating liquid C exhausted through the liquid dispensing passage 12*a* has a constant pressure so that the coating layer coated on the surface of the sheet S has a uniform thickness in the longitudinal and transverse directions thereof.

Below are examples of tests obtained by using the extrusion-type coating apparatus according to the present invention.

Test1 inner diameter of the hollow core: liquid receiving hole 19 mm, liquid discharging hole 20 mm material for the hollow core: SUS 316 plated at a surface thereof with a hard chrome width of the slit: 0.2 mm gap between the inner wall of the manifold and the outer wall of the hollow core: 3 mm supplying amount of the coating liquid: 20 liter/min coating velocity: 100 m/min coating width: 150 mm sheet: polyethylene terephtalate resin film, width 15 $\mu$M viscosity of the coating liquid: 1000 centipoise composition of the coating liquid: Co-r-Fe203(specific surface area 30 $m^2$/gram, coercive force 6500 e) 100 parts, alumina 5 parts, carbon black 5 parts, poly vinyl chloride-vinyl acetate copolymer resin 12 parts, polyester-urethane copolymer resin 10 parts, lauric acid 1 parts, stearic acid 1 part, butyl stearate 2 parts, polyisocyanate 10 parts, methylethylketon 120 parts, toluene 120 parts, and cyclohexanon 80 parts.

In the above condition, a coating layer having a thickness of 4 $\mu$m with the coating layer being uniformly formed in the longitudinal and transverse directions thereof is obtained.

Test2 inner diameter of the hollow core: liquid receiving hole 9.5 mm, liquid discharging hole 10 mm material for the hollow core: SUS 316 plated at a surface thereof with a hard chrome width of the slit: 0.1 mm gap between the inner wall of the manifold and the outer wall of the hollow core: 2.5 mm supplying amount of the coating liquid: 10 liter/min
coating velocity: 100 m/min
coating width: 150 mm
sheet: polyethylene terephtalate resin film, width 15 $\mu$m
viscosity of the coating liquid: 20 centipoise
composition of the coating liquid: nitrocellulose resin 10 parts, dyes 1 parts, plasticizer 3 parts, isocyanate 5 parts, methylethylketone 30 parts, and cyclohexanon 10 parts.

In the above condition, a coating layer having a thickness of 1 $\mu$M with the coating layer being uniformly formed in the longitudinal and transverse directions thereof is obtained.

As described above, the extrusion coating apparatus according to the present invention dispenses a coating liquid at a constant pressure unto the surface of a sheet through a hollow core, a manifold, and a liquid dispensing passage so that a coating layer having a uniform thickness in the longitudinal and transverse directions thereof is formed on the surface of the sheet.

Further, the extrusion coating apparatus according to the present invention can adjust the thickness of the coating layer, and can be easily handled.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A coating apparatus for extruding a coating material onto a substrate comprising:

a body including a manifold extending through the body and a passage communicating with said manifold, said passage extending to a surface of said body to form an opening on the body; and a hollow core member disposed in said manifold and having a length, said core member having a slit extending along the entire length thereof and first and second ends, wherein an interior diameter of said core member increases along a direction from said first end to said second end, wherein said hollow core member is arranged for containing the coating material and supplying the coating material to the slit that the coating material extruding from the slit then through the passage and the opening is applied onto the substrate.

2. The apparatus as claimed in claim 1, wherein said slit faces an opposite side of said manifold from said passage.

3. The apparatus as claimed in claim 1, wherein said core member is uniformly spaced from an interior surface of said manifold.

4. The apparatus as claimed in claim 1, wherein said core member is uniformly spaced 5 mm or less from the interior surface of said manifold.

5. The apparatus as claimed in claim 1, wherein a width of said slit is between 5 mm and 10 mm.

6. The apparatus as claimed in claim 1, wherein an interior diameter of said core member is less than 40 mm.

7. The apparatus as claimed in claim 6, wherein an interior diameter of said core member is between 5 mm and 20 mm.

* * * * *